United States Patent [19]

Brunone

[11] 4,290,254

[45] Sep. 22, 1981

[54] BEVERAGE CARRIER HANDLE FEEDER AND INSERTER

[75] Inventor: William T. Brunone, Plymouth, Minn.

[73] Assignee: Champion International Corporation, Stamford, Conn.

[21] Appl. No.: 117,470

[22] Filed: Feb. 1, 1980

[51] Int. Cl.[3] ..... B65B 61/14

[52] U.S. Cl. ..... 53/413; 53/48; 53/134

[58] Field of Search ..... 53/413, 134, 48, 591, 53/398; 198/622, 625, 657, 663, 420

[56] References Cited

U.S. PATENT DOCUMENTS

| | | | |
|---|---|---|---|
| 1,750,327 | 3/1930 | Olsen | 198/625 |
| 3,097,740 | 7/1963 | Poupitch | 53/413 |
| 3,165,868 | 1/1965 | MacDonald | 53/591 X |
| 3,204,386 | 9/1965 | Creed | 53/134 X |
| 3,488,911 | 1/1970 | Poupitch | 53/413 |
| 3,492,777 | 2/1970 | Zilahy | 53/48 |
| 3,826,060 | 7/1974 | Vergozzi | 53/48 |

*Primary Examiner*—John Sipos

*Attorney, Agent, or Firm*—Evelyn M. Sommer

[57] ABSTRACT

A beverage carrier (package) handle feeder and inserter which is utilized in association with a conveyor for transporting beverage carriers from one location to another. The beverage carrier handle feeder and inserter has a pair of spaced apart cylindrically-shaped members. Each cylindrically-shaped member has a spiral groove formed therein for engaging and feeding the handles to a preselected position with respect to the beverage carriers. A support rod is located adjacent one end of the cylindrically-shaped members for supporting a plurality of handles to be engaged by and fed by the cylindrically-shaped member. Due to the specific angular relationship between the cylindrically-shaped members and the beverage carriers, and due to the design of the handles, individual handles are systematically inserted into individual beverage carriers during the feeding procedure.

7 Claims, 3 Drawing Figures

BEVERAGE CARRIER HANDLE FEEDER AND INSERTER

BACKGROUND OF THE INVENTION

This invention relates generally to packaging and conveying systems, and more particularly, to a system which is capable of reliably and efficiently separating handles and of subsequently inserting individual handles within the packages in order to produce a package having a handle fixedly secured thereto.

In the field of packaging articles and more specifically in the class of packages encompassing beverage carriers, it is of utmost importance to provide handles as part of the package. For example, beverage carriers which contain a plurality of bottles or cans therein and are provided with handles can be easily carried or transported from one location to the other in a safe and efficient manner.

A conventional procedure for producing such packages generally involves a three-step operation; (1) the manufacture of the package itself, (2) the filling of the package, with, for example, beverage bottles or cans, and (3) the attachment to the package of a handle.

Generally, the handles are either manually attached to the package or automatically secured to the package in an automated fashion by specifically designed machines. Unfortunately, manual attachment of the handle to the package is not only time consuming but as a consequence of the costs involved in maintaining a work staff, also extremely uneconomical. Mechanization of the procedure also leaves much to be desired since complex machinery is generally involved in not only separating the individual handles to be utilized with the completed packages but also in successfully attaching the handles to the packages. Thus, the added convenience of being able to easily carry a package such as a beverage carrier by means of handle may increase the overall cost of the item packaged to a point where providing handled packages, in most instances, is considered to be cost ineffective.

A need therefore arises in the packaging industry to produce a reliable and economical mechanized system for not only separating handles from a stack of handles but also to provide a capability within the system which permits the rapid securing of those handles to packages.

SUMMARY OF THE INVENTION

The instant invention overcomes the above-mentioned problems by providing a beverage carrier handle feeder and inserter which can with a minimum of operative elements provide beverage carriers or any other type of package with an effective handle.

The basic component of this invention are a pair of spaced apart counter-rotating timing feed screws, a plurality of spring biased handles and a means for supporting the handles adjacent the feed screws. The pair of timing feed screws, per se, are generally available with slight modification in the packaging industry since they are already useful in moving forward, spacing and orienting objects during the procedure of manufacturing and filling the package itself. Consequently, time consuming and expensive purchase of additional complex machinery is unnecessary. Modification is necessary in order to permit accommodation of the handle by the feed screws and in positioning of the feed screws relative to the packages being conveyed there beneath.

The handles which are utilized with the beverage carrier handle feeder and inserter of this invention are inexpensive to produce. They are formed of a U-shaped resilient material such as thin metal or plastic and can be secured to the package through small openings within the package. Once in place, the handle, due to a spring-like action locks itself securely to the package.

The feed screws of this invention are mounted at a preselected angular relationship with respect to an already existing conveyor belt utilized in the packaging industry. An elongated rod is located intermediate to and at one end of the pair of feed screws for supporting a stack of handles thereon. The packages pass beneath the feed screws on the conveyor belt with the feed screws having the other end thereof at a height substantially equal to that of the packages. Any suitable motor is operably attached to the feed screws in order to synchronize the counter rotation of each feed screw to that of the conveyor belt.

As the feed screws rotate a notched spiral groove formed in each of the feed screws simultaneously engage therebetween a handle from the stack of handles and moves the handle at a preselected speed toward the packages on the conveyor belt. Thus, the handles are sequentially removed from the stack of handles in timed relationship with respect to the packages passing therebeneath. Once the position of the handles and velocity of the packages coincide, the feed screw due to its angular relationship with respect to the packages proceeds to insert an individual handle into each package passing therebeneath.

Since the handles are formed of a spring-like material which collapses inwardly upon insertion through openings within the package, once inserted, the handles spring outwardly to frictionally engage the sides of the package or are disposed below an opening in the package top and pulled through. By proper synchronization between the rotation speed of the feed screws and the speed of the conveyor belt the packages will leave the belt having a handle secured thereto.

It is therefore an object of this invention to provide a handle feeder and inserter for a package such as a beverage carrier or the like.

It is another object of this invention to provide a beverage carrier handle feeder and inserter which is made up of a minimal number of operative elements.

It is still another object of this invention to provide a beverage carrier handle feeder and inserter which is readily adaptable for use with an already existing package conveying system.

It is a further object of this invention to provide a beverage carrier handle feeder and inserter which is economical to produce.

It is still a further object of this invention to provide a beverage carrier handle feeder and inserter which can be easily manufactured from already available components.

For a better understanding of the present invention together with other and further objects thereof, reference is made to the following description taken in conjuction with the accompanying drawing and its scope will be pointed out in the appended claims.

DETAILED DESCRIPTION OF THE PREFERRED EMBODIMENT

Figures 1, 2, 3:
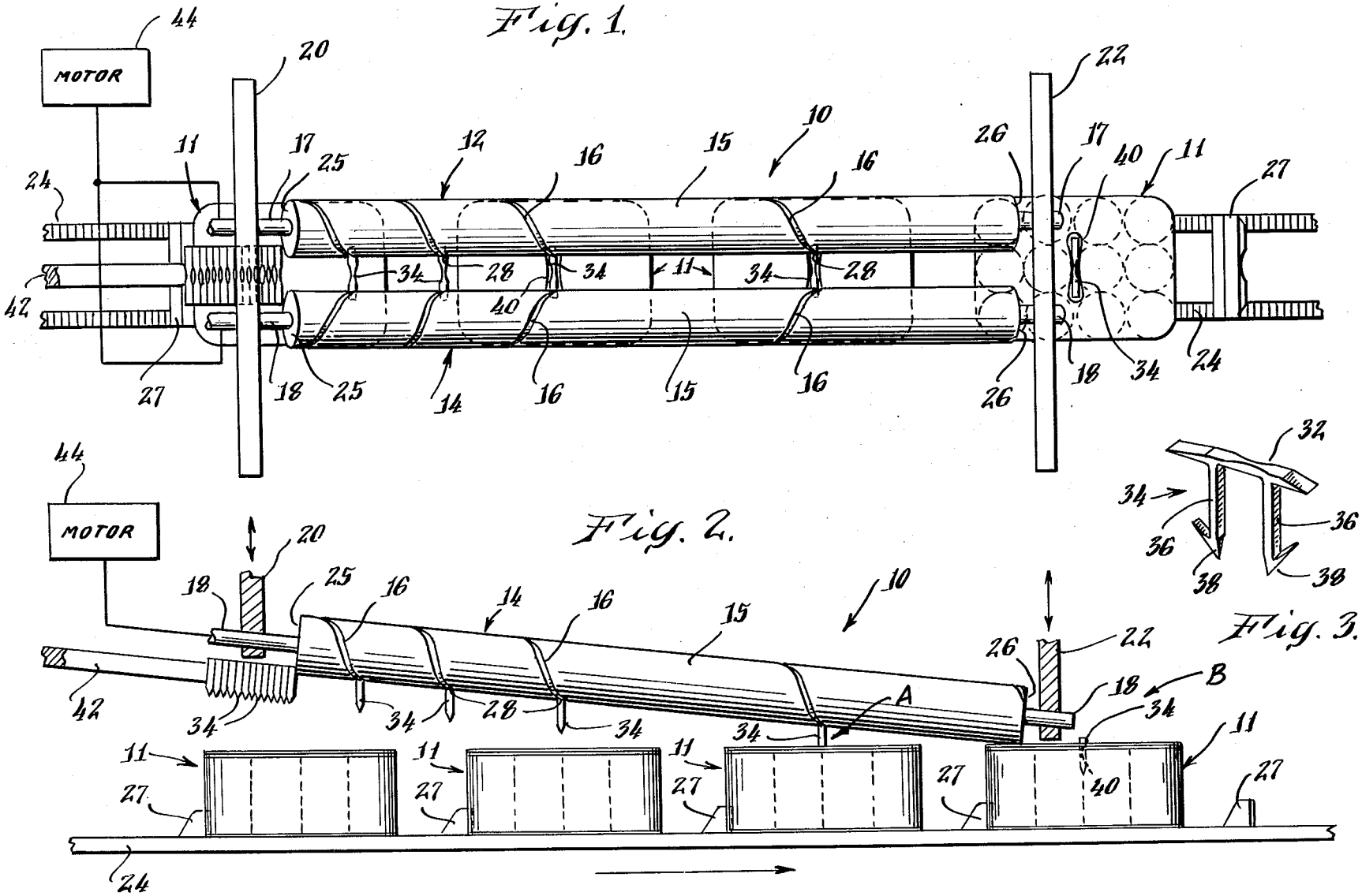
FIG. 1 is a plan view of the beverage carrier handle feeder and inserter of this invention.
FIG. 2 is a side elevational view of the beverage carrier handle feeder and inserter of this invention, shown partly in cross section.
FIG. 3 is a pictorial representation of the handle utilized in conjuction with the beverage carrier handle feeder and inserter of this invention.

Reference is now made to FIGS. 1 and 2 of the drawing which clearly depict the beverage carrier handle feeder and inserter 10 of this invention. It should be noted, however, that although the system of this invention finds its greatest applicability with respect to conventional beverage carriers 11 as shown in the drawing, this invention is readily adaptable for use with any type of package with which a handle would increase its effectiveness. Consequently, the terms beverage carrier and package may be used interchangably throughout this specification.

Constituting the main elements of this invention are a pair of timing feed screws 12 and 14. Each feed screw 12 and 14, respectively, is formed of an elongated cylindricallyshaped body 15 having a spiral groove 16 formed therein in manner to be described in detail herein below. The feed screws 12 and 14 are aligned with each other in a spaced apart fashion by having axial shafts 17 and 18 of each feed screw 12 and 14, respectively, rotably secured within any suitably adjustable housing 20 and 22 at each end of screws 12 and 14. Each housing 20 and 22 may be adjusted in the vertical direction in a conventional manner such as by a manual or motorized gearing arrangement (not shown) in order to align feed screws 12 and 14 at a specific angular relationship with respect to a conveyor belt 24 passing therebeneath. The specific angular relationship between feed screws 12 and 14 and conveyor belt 24 is defined by the height of packages 11 situated on conveyor belt 24. As clearly depicted in FIG. 2 of the drawing, feed screws 12 and 14 are positioned such that one end 25 of each feed screw 12 and 14 is situated substantially above packages 11 while the other end 25 of each feed screw 12 and 14 is substantially aligned with the top of packages 11.

Any suitable securing means such as abutments 27 may be periodically spaced on conveyor belt 24 so as to engage a package 11 and cause its movement along with conveyor belt 24. adjacent feed screws 12 and 14. Movement of conveyor belt 24 is accomplished by any conventional driving means such as a motor and is not illustrated in the drawing since its operation is well-known in the art.

Still referring to FIGS. 1 and 2 of the drawing each of timing feed screws 12 and 14 as indicated above contain in a spiral configuration along the longitudinal length thereof a groove 16 containing a notched portion 28 extending transversely of the groove.

Notched grooves 16 matingly engage therebetween the sides of top support 32 of a handle 34 more clearly shown in FIG. 3 of the drawings.

Each handle 34 is made preferably of a slightly resilient material such as thin metal of plastic and has attached to top support 32 a pair of legs 36 having a hook-like protrusion 38 at each end thereof. By being structured in such a manner, handle 34 can be readily inserted within an opening 40 located in the top of package 11 in a manner to be described in detail hereinbelow. It should however be realized that the best configuration of handle 34 may vary within the confines of this invention.

Supporting a plurality of handles 34 and situated adjacent feed screws 12 and 14 is a mounting rod 42. Mounting rod 42 which is also inclined with respect to conveyor belt 24 is positioned intermediate feed screws 12 and 14 so as to allow handles 34 to move by gravity to a position wherein they can be accepted by the notched, spiral grooves 16 of feed screws 12 and 14, respectively. This is accomplished by each notch 28 of groove 16 slidably securing a handle therebetween. As the feed screws 12 and 14 rotate in an opposing direction with respect to each other the progressive turning of spiral grooves 16 moves successive handles 34 along the longitudinal length of screws 12 and 14 as clearly depicted in FIG. 2 of the drawing.

Any suitable driving means such as motor 44 is operably connected to the axial shafts 17 and 18 of feed screws 12 and 14, respectively, in a conventional manner in order to rotate, in opposing directions, through appropriate conventional gearing (not shown) feed screws 12 and 14 at a preselected speed. This speed is in direct relationship to the speed of conveyor belt 24 in order to maintain proper alignment between packages 11 and handles 34.

As each handle 34 is carried by means of feed screws 12 and 14 toward packages 11 as shown in FIG. 2, at a particular height above a package 11 (illustrated as point A in FIG. 2) the legs 36 of handle 34 begin to compress and protrude through the opening 40 within package 11. Subsequent lowering of handle 34 further inserts legs 36 of handle 34 into package 11. After sufficient insertion within package 11, legs 36 will spring back to their original configuration and hooks 38 will frictionally abut the sides of opening 40 of package 11. Again it should be emphasized that the exact manner of handle/package engagement may vary within the scope of this invention.

As long as the rotational speed of feed screws 12 and 14 are maintained in direct relationship to the speed of the packages 11 passing therebeneath, each handle 34 will be secured in an appropriate manner to a package in alignment therewith. Thereafter, as the package 11 leaves the area adjacent feed screws 12 and 14 (illustrated as point B in FIG. 2) a handle 34 remains as a part of package 11.

Although this invention has been described with reference to a particular embodiment, it will be understood to those skilled in the art that this invention is also capable of a variety of alternate embodiments within the spirit and scope of the appended claims.

What is claimed is:

1. A package feeder and inserter system comprising means for conveying a plurality of packages at a preselected speed in a substantially horizontal, linear path, means for supporting a plurality of handles adjacent said conveying means, means in juxtaposition to said supporting means for sequentially engaging each of said plurality of said handles and feeding each of said handles along a linear path to a preselected position adjacent a different one of said packages, respectively, said engaging and feeding means comprising a pair of spaced apart longitudinally extending cylindrically-shaped members, each of said members having a spiral groove along the length thereof, and said handle supporting means being interposed between said pair of cylindrically-shaped members whereby said grooves of said members sequentially engage each of said handles and feed each of said handles to said preselected position along the spiral grooves thereof, means operably connected to said handle engaging and feeding means for rotating each of said cylindrical engaging and feeding means in a counter direction to each other at a preselected speed relative to said conveying means, and means for supporting said cylindrical engaging and feeding means at a preselected downwardly angular relationship with respect to said conveying means whereby each of said handles meets and is inserted into said different one of said packages, respectively, at said preselected position.

2. A package handle feeder and inserter system as defined in claim 1 wherein each of said handles comprises a U-shaped element made of a spring-like material having a top support and a pair of spaced apart legs extending therefrom, said legs being capable of being inserted into said package.

3. A package handle feeder and inserter system as defined in claim 1 wherein each of said cylindrically-shaped members is a timing feed screw.

4. A package handle feeder and inserter system as defined in claim 2 wherein said spiral grooves of each of said cylindrically-shaped members terminate in a notched portion extending transversely of each of said grooves of said cylindrically-shaped members and engaging said top support of each of said handles during the engagement and feeding thereof.

5. A package handle feeder and inserter system as defined in claim 4 wherein said support means comprises a rod interposed between said cylindrically-shaped members adjacent one end thereof and said rod being inclined at a downwardly extending angle with respect to said conveying means in order to position each of said handles adjacent said notched portion of said spiral grooves.

6. A method of feeding handles to and inserting said handles into packages comprising the steps of:

(a) sequentially separating individual handles from a plurality of handles, (b) linearly feeding each of said handles at a preselected rate of speed and at a preselected angular relationship with respect to a plurality of said packages being, linearly and horizontally conveyed at a preselected speed therebeneath, (c) aligning each said handles being fed with a different one of said packages, respectively, being conveyed by synchronizing said preselected rate of speed of feeding said handles with said preselected speed of conveying said packages, and (d) inserting each of said handles in said different one of said packages, respectively, at a preselected position, wherein said steps of periodically separating individual handles, feeding said handles at a preselected speed and inserting each of said handles into a different one of said packages, respectively, is accomplished by rotating a pair of spaced apart cylindrically-shaped members positioned at said preselected angular relationship with respect to said packages, each member having a spiral groove therein for engaging said handles therebetween.

7. A method of feeding handles to and inserting said handles into packages as defined in claim 6, further comprising the step of aligning one end of said cylindrically-shaped members substantially above the top of said packages and aligning the other end of said cylindrically-shaped member in substantial alignment with the top of said packages.

* * * * *